US012791291B2

(12) United States Patent
Walker

(10) Patent No.: US 12,791,291 B2
(45) Date of Patent: Nov. 10, 2026

(54) BALLISTIC SHELL CARTRIDGE RECOVERY MAT SYSTEM

(71) Applicant: Will Walker, Granite Shoals, TX (US)

(72) Inventor: Will Walker, Granite Shoals, TX (US)

( * ) Notice: Subject to any disclaimer, the term of this patent is extended or adjusted under 35 U.S.C. 154(b) by 224 days.

(21) Appl. No.: 18/769,283

(22) Filed: Jul. 10, 2024

(65) Prior Publication Data

US 2026/0016270 A1 Jan. 15, 2026

(51) Int. Cl.

| | |
|---|---|
| ***F41J 13/00*** | (2009.01) |
| ***A47G 9/06*** | (2006.01) |
| ***F42B 39/26*** | (2006.01) |
| *F42B 33/10* | (2006.01) |

(52) U.S. Cl.

CPC ..... *F41J 13/00* (2013.01); *A47G 9/062* (2013.01); *F42B 39/26* (2013.01); *F42B 33/10* (2013.01)

(58) Field of Classification Search

CPC ..... F41J 13/00; A47G 9/062
USPC ..... 273/410
See application file for complete search history.

(56) References Cited

U.S. PATENT DOCUMENTS 3,226,737 A * 1/1966 Rote ..... E04H 15/56 135/120.1
4,634,618 A * 1/1987 Greer ..... A47G 9/062 428/126
5,443,880 A * 8/1995 Wike ..... A47K 10/02 2/253
6,192,536 B1 * 2/2001 Connors ..... A47G 9/062 5/419
D551,891 S * 10/2007 Kaiser ..... D6/595
D1,096,240 S * 10/2025 Henderson Lawrence .... D6/608

FOREIGN PATENT DOCUMENTS

CN 208610729 U * 3/2019

OTHER PUBLICATIONS

CED Brass Mat https://www.doublealpha.biz/us/ced-brass-mat (Year: 2019).*
Toy Storage Organizer https://www.amazon.com/Creative-QT-SlideAway-Storage-Basket/dp/B087GCRB15?th=1 It is noted that the reference cannot be dated, but be aware that this reference (or similar) may be able to be properly dated as prior art (Year: 2026).*
CN-208610729-U English Translation (Year: 2019).*

* cited by examiner

*Primary Examiner* — Kyle R Grabowski
(74) *Attorney, Agent, or Firm* — William Lovin & Associates LLC; William R. Lovin

(57) ABSTRACT

The invention relates to a device and a method of using the device for collecting, transporting, and storing spent cartridge casings wherein the device is composed of a generally square mat, with a handle or hand accommodating device configured as a pocket affixed at each of three corners and a collection and storage bag affixed to the fourth corner.

4 Claims, 2 Drawing Sheets

BALLISTIC SHELL CARTRIDGE RECOVERY MAT SYSTEM

CROSS-REFERENCE TO RELATED APPLICATIONS

Not applicable.

FIELD OF THE INVENTION

The present disclosure relates to a device for recovering spent ballistic shell cartridges after they are shot and method for using the device while shooting firearms.

BACKGROUND OF THE INVENTION

Automatic rifles such as the M-16.223 caliber machine gun and the Thompson. 45 caliber machine gun primarily utilize magazine fed ammunition and automatically cycle a new round into the receiver of the weapon after a previous round has been fired. Similarly, Remington Model 870 or 1100 feed a new round into the chamber every time the slide is racked. The shell cartridge of the previous round is ejected through a discharge port and falls to the ground. Also, some firearms do not automatically discharge after they are discharged and the cartridges must be manually tossed, thrown, or otherwise placed on the net. In this manner the user could stand on the net. Moreover, two or more people could simultaneously use the net.

What is needed therefore is a device and a system of using the device whereby expended ballistic shell cartridges are caught and collected so that they might be subsequently refurbished and reloaded for an additional use.

It is therefore an object of the present invention to provide an appliance that allows a gunner to capture and collect expended ballistic shell cartridges so that they may be reused.

It is also an object of the present invention to provide a method of using the appliance to transport these expended ballistic shell cartridges so that they may be refinished and reloaded and reused.

SUMMARY OF THE INVENTION

The invention is in the general form of a square mat of flexible fabric material with handles or other hand accommodating fixtures at three corners and a collection and storage bag at the fourth corner.

The flexible fabric material may be a fine mesh material woven of cloth, fiberglass, or of fine metal; a cloth fabric such as canvas or cotton or linen; a flexible plastic material such as a polymer or polyurethane mesh in the form of a sheet, and the like.

The handles or other hand accommodating fixtures at three corners of the mat may be constructed of flexible material such as canvas or leather or solid material such as steel, aluminum, plastic, or iron. The handles or other hand accommodating fixtures are affixed to the generally square mat of flexible fabric. In a preferred embodiment, the handles or other hand accommodating fixture at three corners may be pockets in which with rocks or other weighted items may be placed to weight down the mat while in use.

The collection and storage bag at the fourth corner of the mat is open at the end directly affixed to the mat and has a drawstring closure near its other end. In a preferred embodiment, the drawstring may be at end of the bag. By this means the drawstring may be tightened to close the collection and storage bag and spent cartridges lying on the mat may be, as the mat is picked up using the three handles or hand accommodating fixtures, rolled into the collection and storage bag. Lastly, the entirety of the mat is folded and rolled up such that it can be stuffed into the collection and storage bag sealing the spent cartridge casings inside the collection and storage bag. In this form, the mat and the spent cartridge casings may be transported together.

At some later time, the drawstring around the collection and storage bag is released and the collection and storage bag is opened thus giving access to the spent cartridge casings inside. The spent cartridge casings may be reloaded or otherwise processed at this time.

DETAILED DESCRIPTION OF THE PREFERRED EMBODIMENTS

Figure 1:
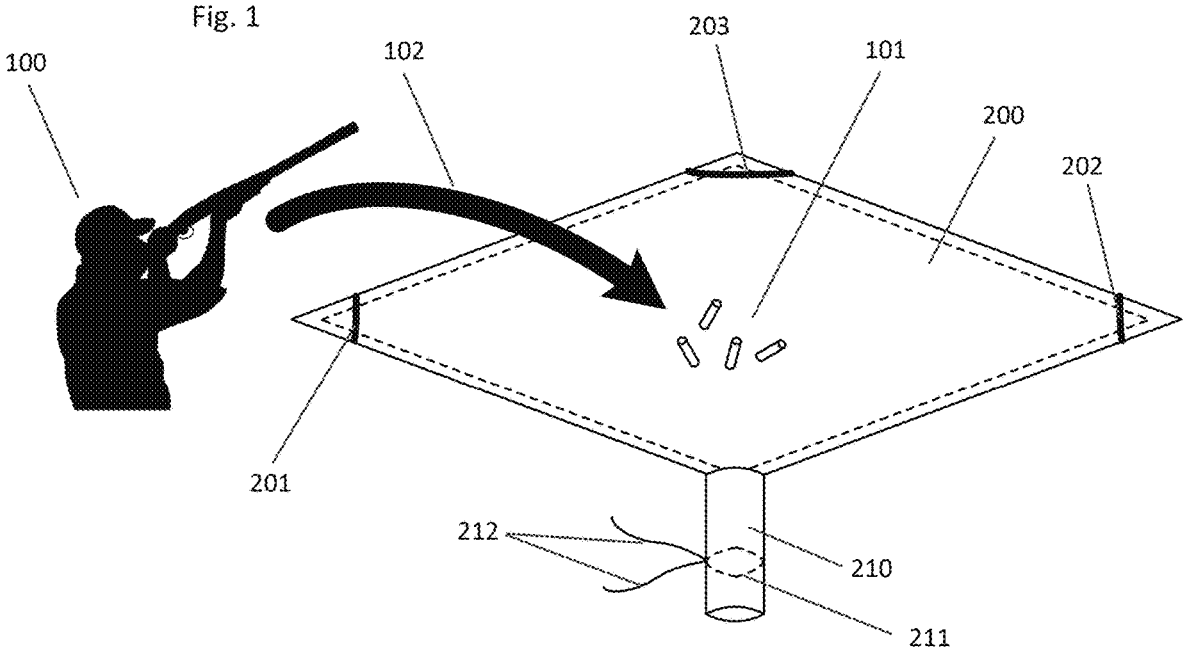
FIG. 1 is a diagrammatic view of the present invention as deployed on the ground with a shooter standing next to it so that spent cartridge casings from a gun are ejected onto the top surface of the present invention. The drawstring is presently loosened around the collection and storage bag.

Referring now to FIG. 1, the first embodiment of the device the mat 200 is typically deployed on the ground next to a shooter 100 shooting a firearm that discharges 102 spent cartridge casings 101 with every shot.

The type of firearm is variable, ranging from a Colt-type AR-15 or M-16 type of rifle or a Remington Model 870 or 1100 type shotgun to an M-2 Browning type of machine gun. In all cases the firearm generally must automatically discharge spent cartridge casings or hulls with every shot. Firearms that do not discharge cartridge casings with every shot (i.e. a revolver-type of pistol or a side-by-side-type of shotgun) must be unloaded in such a manner that the spent cartridge casings are placed on mat 200.

Mat 200 is in the general form of a square composed of flexible fabric material with handles 201, 202, and 203 or other hand accommodating fixtures at three corners and a collection and storage bag 210 at the fourth corner.

The flexible fabric material may be a fine mesh material woven of plastic, cloth, fiberglass, or fine metal; a cloth fabric such as canvas or cotton, synthetic material or linen; a sheet of flexible plastic material such as a polymer or polyurethane mesh in the form of sheet, a sheet of woven fiberglass and the like.

The handles 201, 202, or 203 or other hand accommodating fixtures at three corners of the mat may be constructed of flexible material such as canvas or leather or solid material such as steel, aluminum, plastic, or iron. The handles 201, 202, or 203 or other hand accommodating fixtures are affixed to the generally square mat 200 of flexible fabric.

The collection and storage bag 210 at the fourth corner of the mat is open at the end directly affixed to the mat 200 and has a drawstring closure 211 and 212 near its other end.

Figure 2:
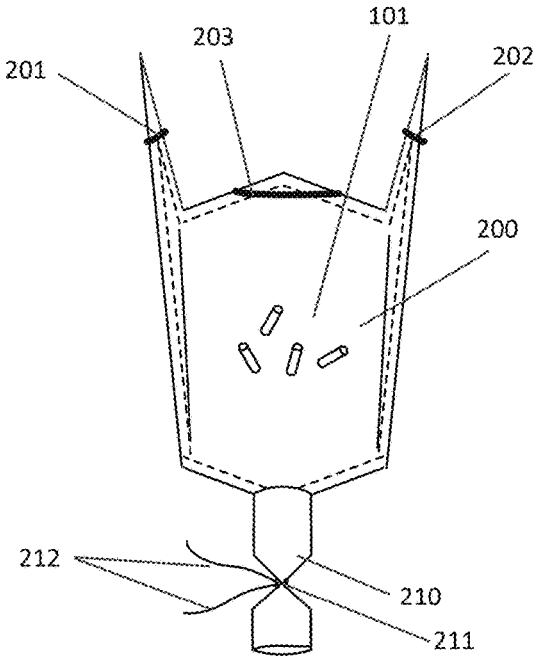
FIG. 2 is a diagrammatic view of the present invention with the two handles on either side of the collection and storage bag being lifted. The drawstring is tightened around the collection and storage bag. The spent cartridge casings are in the center of the mat.

Turning now to FIG. 2, the drawstring closure 211 and 212 may be tightened to close the middle of collection and storage bag 210. By this means, spent cartridges 101 are retained near the center of mat 200 as the corners of the mat are picked up using handles 201, 202, and 203 or hand accommodating fixtures.

Figure 3:
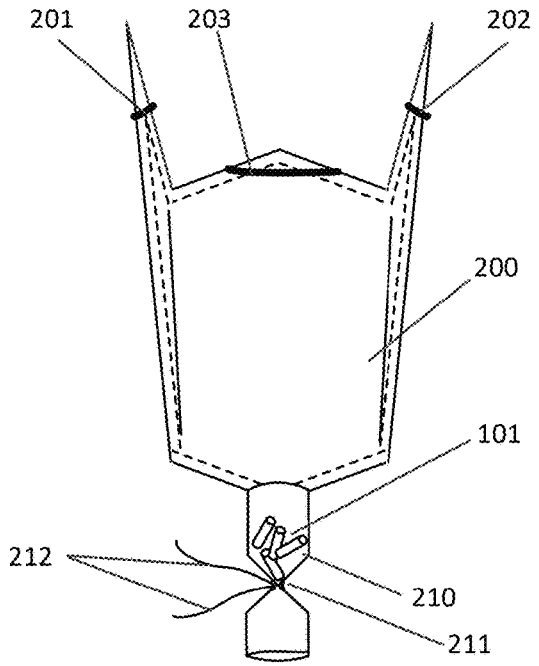
FIG. 3 is a diagrammatic view of the present invention with the two handles on either side of the collection and storage bag being lifted. The drawstring is tightened around the collection and storage bag. The spent cartridge casings have been rolled or otherwise repositioned into the collection and storage bag.

Turning now to FIG. 3, spent cartridges are rolled from the center of the mat 200 into the collection and storage bag 210.

Figure 4:
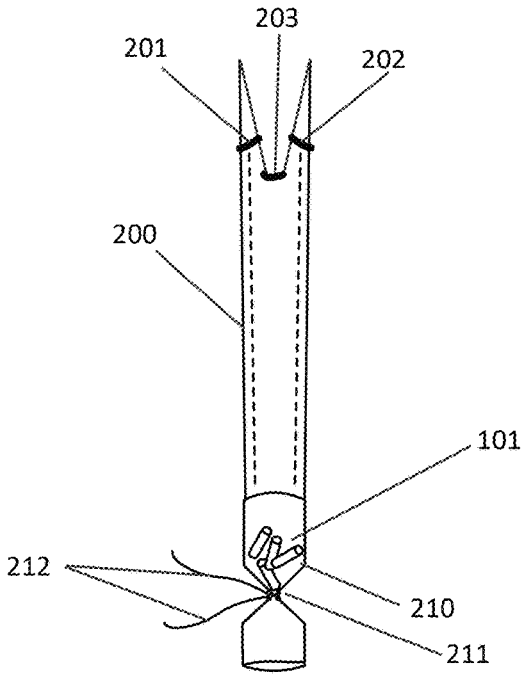
FIG. 4 is a diagrammatic view of the present invention with all three handles attached to the mat being lifted. The mat is folded into a linear array. The drawstring is tightened around the collection and storage bag. The spent cartridge casings have been rolled or otherwise repositioned into the collection and storage bag.
Figure 5:
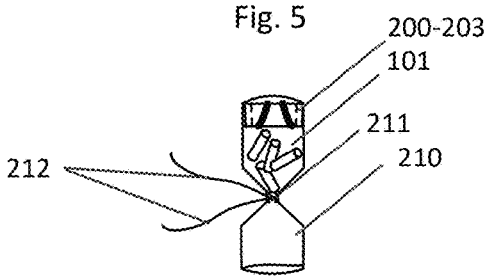
FIG. 5 is a diagrammatic view of the present invention with the linear array of the mat rolled up and positioned into the top of the collection and storage bag sealing the spent cartridge casings inside the collection and storage bag. The drawstring is tightened around the collection and storage bag. The entire assembly may be transported this way.

Turning now to FIGS. 4 and 5, the entirety of the mat 200 (including handles 201, 202, and 203 or hand accommodating fixtures) is folded and rolled up such that it can be stuffed into the collection and storage bag 210 sealing the spent cartridge casings 101 inside the collection and storage bag 210. In this form, the mat 200 (including handles 201, 202, and 203 or hand accommodating fixtures) and the spent cartridge casings 101 may be picked up and physically transported together.

Figure 6:
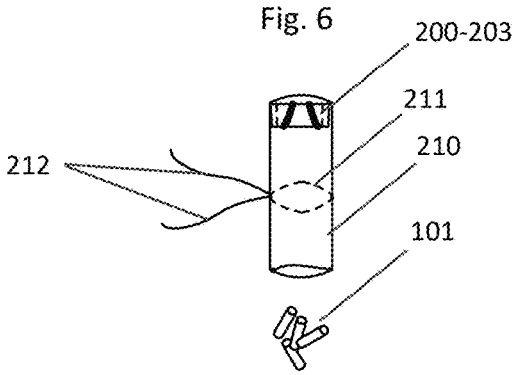
FIG. 6 is a diagrammatic view of the present invention with the linear array of the mat rolled up and positioned into the top of the collection and storage bag. The drawstring is loosened, and the spent cartridge casings are rolled out of, or otherwise repositioned out of, the collection and storage bag.

Turning now to FIG. 6, at some later time, the drawstring closure 211 and 212 around the collection and storage bag 210 is released and the collection and storage bag 210 is opened thus giving access to the spent cartridge casings 101 inside. The spent cartridge casings 101 may be removed and reloaded or otherwise processed at this time.

While the invention has been described in connection with what are the most practical and preferred embodiments, it is to be understood that the invention is not to be limited to the disclosed embodiments, but on the contrary is intended to cover various modifications and equivalent arrangements included within the spirit and scope of the disclosure. More specifically: 1) Variants that seek to increase the number of spent cartridge casings 101 that may be contained and transported; and/or, 2) Variants that seek to change the overall shape of the device, from its present generally square mat 200 shape to other geometries (e.g. rectangular, pentagonal, hexagonal, etc.); 3) Variants which may be attached, or otherwise affixed, to the firearms with which they are used; 4) Variants that change the number of individuals that can simultaneously use the device; and/or, 5) Substitutions to the type or types of materials from which the sheet is constructed are included within the spirit and scope of the present disclosure.

What is claimed is:

1. A method of using a ballistic shell cartridge recovery mat, wherein a ballistic shell cartridge recovery mat comprises:

a. a generally square mat composed of flexible material, wherein the flexible material is selected from the following list:
   i. fabric;
   ii. fiberglass; or
   iii. nylon mesh;
b. wherein a handle is affixed to each of three corners;
c. wherein a tubular collection and storage bag is affixed to the fourth corner such that it extends linearly away from the center of the mat;
d. wherein a drawstring closure is affixed around the tubular collection and storage bag; and, the ballistic shell recovery mat is used in the following manner:
e. laying the ballistic shell cartridge recovery mat on the ground next to the location where a shooter will fire a gun;
f. spreading the ballistic shell cartridge recovery mat out in a position suitable for use by the shooter in the act of shooting;
g. placing a rock or other weighted object onto at least one of the handles and/or the tubular collection and storage bag;
h. opening the drawstring closure around the tubular collection and storage bag if the drawstring closure is closed;
i. wherein the shooter takes at least one shot wherein a spent casing is discharged from, or is otherwise placed on, the ballistic shell cartridge recovery mat;
j. wherein the shooter removes and discards the weighted object placed onto at least one of the handles and/or the tubular collection and storage bag;
k. wherein the shooter picks up the ballistic shell cartridge recovery mat by lifting at least two corners where handles are attached;
l. wherein spent cartridge casings are deposited into the tubular collection and storage bag;
m. wherein the ballistic shell cartridge recovery mat with handles is folded or rolled up and then inserted into the attached end of the tubular collection and storage bag; and, the drawstring closure around the tubular collection and storage bag is closed around the tubular collection and storage bag;
n. wherein the ballistic shell cartridge recovery mat is transported to a second location where the drawstring closure around the tubular collection and storage bag is loosened; and, the ballistic shell cartridge recovery mat is removed from the tubular collection and storage bag; and, the spent cartridge casings housed therein are removed for reuse.

2. A method of using a ballistic shell cartridge recovery mat of claim 1, wherein elements g. and h. may occur in either order.

3. A method of using a ballistic shell cartridge recovery mat of claim 1, wherein at least one shooter stands adjacent to the mat.

4. A method of using a ballistic shell cartridge recovery mat of claim 1, wherein at least one shooter stands on the mat.

* * * * *